United States Patent [19]

Van der Wal

[11] 3,950,203

[45] Apr. 13, 1976

[54] METHODS OF APPLYING A TAPE AROUND AN OBJECT OR A STACK OF OBJECTS AND DEVICES FOR CARRYING OUT SAID METHOD

[75] Inventor: Auke Van der Wal, Oss, Netherlands

[73] Assignee: Vereenigde Metaalverpakking en Hechtdraad Industrie B.V.MVM-Endra, Oss, Netherlands

[22] Filed: Apr. 2, 1975

[21] Appl. No.: 564,447

[52] U.S. Cl. ..... 156/213; 53/198 R; 100/33 PB; 156/468; 156/522

[51] Int. Cl.[2] ..... B29C 17/04

[58] Field of Search ..... 156/468, 213, 522, 488, 156/443; 53/228, 198 R, 182, 218, 379; 100/33 PB

[56] References Cited

UNITED STATES PATENTS

| | | | |
|---|---|---|---|
| 2,741,885 | 4/1956 | Allison | 100/33 PB |
| 3,251,171 | 5/1966 | Lagesse | 53/228 X |
| 3,374,598 | 3/1968 | Piroutek | 53/198 R X |
| 3,564,810 | 2/1971 | Faletti et al. | 53/198 R X |
| 3,596,434 | 8/1971 | Zelnick | 53/198 R |
| 3,672,116 | 6/1972 | Ingmarson | 53/198 R X |
| 3,807,117 | 4/1974 | Abrams | 53/198 R X |

*Primary Examiner*—William A. Powell
*Assistant Examiner*—David A. Simmons
*Attorney, Agent, or Firm*—Snyder, Brown and Ramik

[57] ABSTRACT

A method and a device for applying a tape around one or more objects, in which first a tape consisting of two interconnected tapes is passed in U-shaped fashion around the object or objects; thereafter the two tape portions extending beyond the object or objects are moved towards one another and pressed one against the other by means of movable tape strainers; thereupon the tape portions are cut in the contact area and finally the formed tape end portions are interconnected in pairs, in such a manner that the interconnected end portions in the plane of the tape of which they form part.

6 Claims, 8 Drawing Figures

Figure 2:
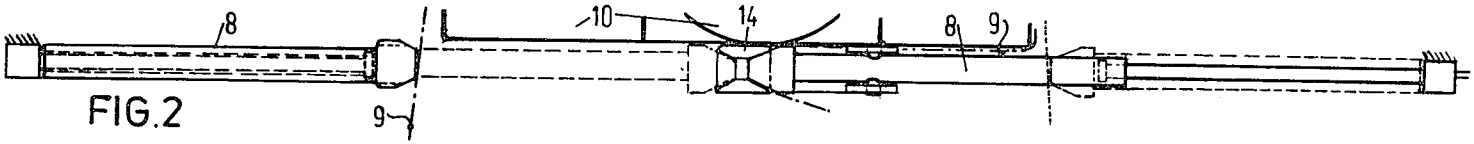

FIG.1
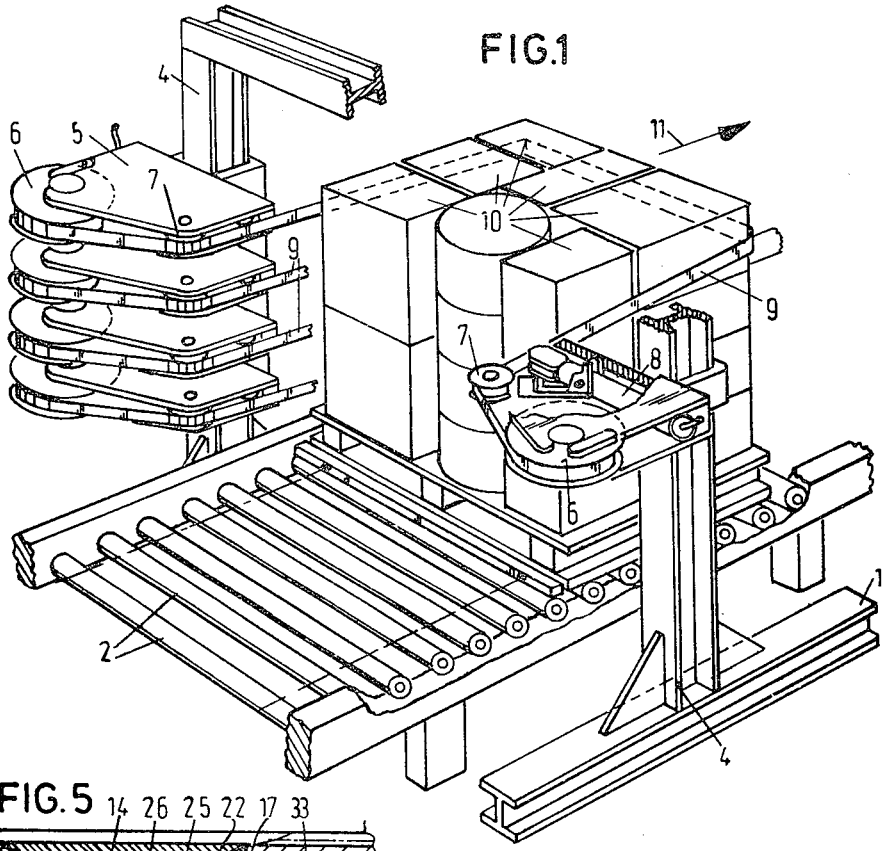
FIG.5
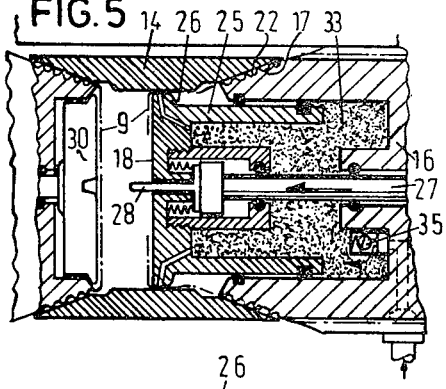
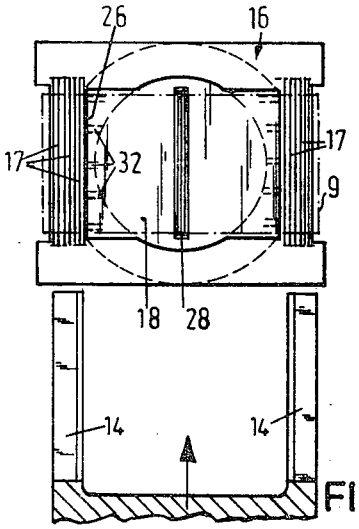
FIG.7
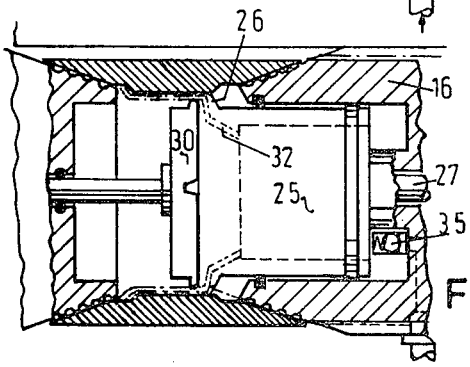
FIG.6

METHODS OF APPLYING A TAPE AROUND AN OBJECT OR A STACK OF OBJECTS AND DEVICES FOR CARRYING OUT SAID METHOD

The invention relates to a method and a device for applying a tape around an object or a stack of objects, in which method a tape extending between two supply reels and consisting of two tapes, which separately emanate from individual supply reels and have their ends interconnected is passed in U-shaped fashion around the object or the stack of objects, and subsequently the tape portions then extending between the object or the stack of objects and the supply reels are forced towards one another along the object or the stack of objects and then connected with one another and severed in a manner such that the objects or the stack of objects is surrounded by a closed tape and apart therefrom a tape extending between said supply reels and consisting of tapes, which emanate from individual supply reels and have their ends interconnected, is again formed.

A tape winding device operating in accordance with said method is known from German Utility Model 1,992,453, published Aug. 22, 1968. This device comprises two tape supply reels spaced apart in the same plane, two tape strainers arranged at the side of said supply reels on the same side of the line of connection between the axes of said supply reels and adapted to move parallel to said line of connection in said plane towards one another and away from one another for forcing around an object or a stack of objects towards one another the portions of a tape located between the object or the stack of objects and the supply reels, said tape being already passed in U-shaped fashion around the object or the stack of objects and consisting of tapes emanating from the two supply reels and having their ends interconnected and means provided on the tape strainers for interconnecting and means provided on the tape strainers for cutting the tape portions forced towards one another by the tape strainers. In this device the tape strainers press the tape portions on one another so that these tape portions engage one another by a part extending perpendicularly to the object or the stack of objects. These interengaging parts of the tape then completely wound around the object or the stack of objects are jointed by spot welding and subsequently cut at the centre.

This known method has the disadvantage that the welded ends of the tape portions around the object or the stack of objects are at right angles to the plane of said tape portions. Therefore, said welded ends may either be troublesome and dangerous during transport of the taped object or the stack of objects or have to be bent over after the application of the tape into the plane of the tape. A further drawback is that the welding joint is exposed to tensile forces so that this method is not appropriate for establishing glued joints between the tape portions and it is hence not suitable for using tape of non-fusible material such as paper-tissue, glass fibres or other fibres impregnated with given kinds of synthetic resins and so on. Moreover, such a weld extending transversely of the plane of the tape takes additional tape material.

The invention has for is object to provide a method and a device, which eliminate the disadvantages of the known method and device and which may be employed not only for applying metal tapes but also for winding non-fusible tapes around objects or stacks of objects. To this end a process is used, in which each of the two tape portions forced towards one another is clamped tight at a given distance from the other tape portion at two spots spaced apart by about twice said given distance in a direction transverse of the object or the stack of objects, after which in order of succession. one tape portion is cut at a spot midway between its two clamping places, the tape ends thus formed between said clamping places and facing one another are directed towards the other tape portion, this other tape portion is also cut at a spot midway between its two clamping places, the resulting tape ends of the other tape portion facing each other are bent over, forced against the tape ends of the first-mentioned tape portion and jointed thereto, whereupon the clamped tape portions are released. In this case the pairs of tape ends to be interconnected are fixed to one another in the plane of each of the tape portions concerned so that the joint is only loaded by shear forces and is, therefore, particularly suitable for glueing. A further advantage resides in that no projecting parts are found at any of the joints beyond the plane of the tape. It is furthermore important that less tape material is required for encircling the object or the stack of objects.

The device for carrying out the method in accordance with the invention is distinguished from said known device in that the facing ends of the tape strainers are each bounded by two clamping faces and an intermediate head face extendng transversely of the direction of movement of the tape strainers, a stop member having two parallel side plates is adapted to be inserted between the two tape strainers, said side plates being bounded each by a clamping face co-operating with a clamping face of one tape strainer and a clamping face co-operating with a clamping face of the other tape strainer and a supporting face extending between said clamping faces in the direction of movement of the tape strainers and facing the other side plate, the dimension of said supporting face in the direction of movement of the tape strainers being approximately equal to half the dimension of the head faces of the tape strainers transverse of said supporting face, the head face of each tape strainer being formed by the head face of a tape bending-over member, which is displaceable with respect to its tape strainer at least over a distance equal to the dimension of the supporting faces in the direction of movement of the tape strainers towards the other tape strainer and moves, during its displacement with its operative bending-over faces closely along the supporting faces of the side plates of the stop member, at least one of the two tape bending-over members having midway between the clamping faces of the tape strainer concerned, a cutting member adapted to be pushed out of its head face, means being provided for jointing overlapping tape ends extending along the supporting faces of the side plates of the stop member and in that driving means are provided for moving in a given order of succession the tape strainers, the stop member, the or each cutting member, the tape bending-over members and the tape jointing means.

In this device the clamping faces of the tape strainers and the clamping faces of the stop member extending parallel to the former can be advantageously inclined outwardly with respect to the head faces and the supporting faces, respectively, and inclined to the rear with respect to the effective movement of the tape strainers.

In this case the tape portions come to lie taut around the head faces and the clamping faces of the tape strainers.

A simple construction and control of the stop member is obtained, when this member is mounted on one of the two tape strainers for pivoting about an axis extending transversely of the direction of movement of the tape strainers. The movement of the stop member can then be readily derived from that of the tape strainer concerned.

A device for applying tapes and glueing together the overlapping tape ends may advantageously be constructed so that the tape bending-over member provided with the cutting member is coupled with a piston adapted to move in a cylinder cavity of the head of the tape strainer concerned and the cylinder space on the side of the piston remote from the head face of said tape bending-over member communicates with glue discharge passages opening into the active bending faces of said bending-over member facing the supporting faces of the side plates of the stop member as well as with a glue supply duct provided with a check-valve opening towards said space. It is then advisable to provide at least one of the tape bending-over members and/or each side plate of the stop member with a heating element. This heating element serves for rapidly drying the glue joint. It will be obvious that with this structure of the tape bending-over members glue is automatically introduced in between the tape ends ot be jointed.

In the case of tapes of metal or other fusible material, when glueing together the overlapping tape ends is not feasible, spot welding electrodes or other heating electrodes may be inserted into the space bounded by the side plates of the stop member and the head faces of the tape strainers forced against the stop member, in which space they can be pressed against the overlapping tape ends held by the supporting faces.

Figure 3:
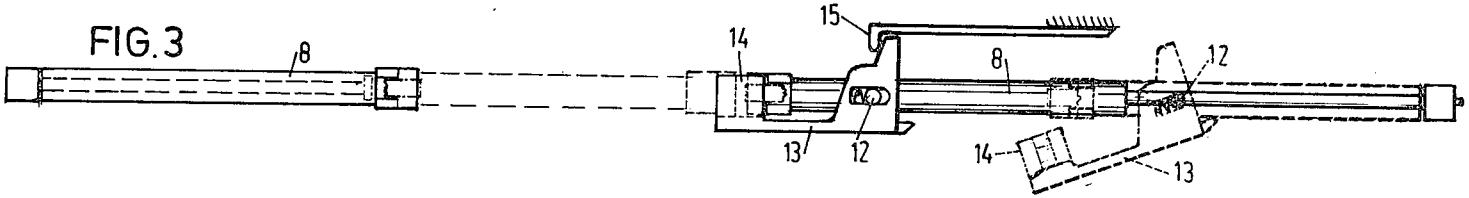
Figure 4:
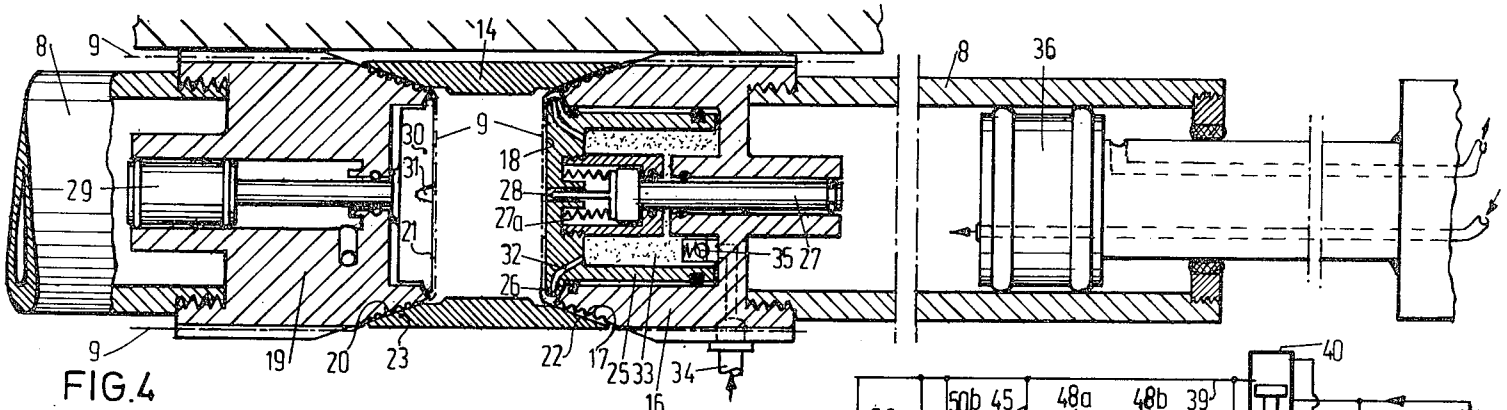
Figure 8:
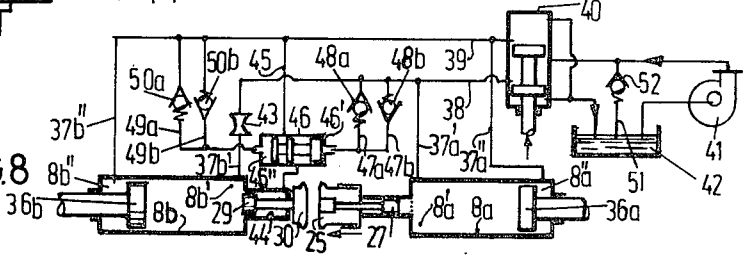

The invention will be described more fully with reference to the accompanying drawing, in which FIG. 1 is a perspective view of a multiple taping device in accordance with the invention, FIG. 2 is a plan view of the tape strainers employed in said device, FIG. 3 is a fron view of said tape strainers, FIG. 4 is an enlarged, horizontal sectional view of parts of the tape strainers as shown in FIGS. 2 and 3 in a position in which they are forced against a stop member disposed between the tape strainers, FIG. 5 is a horizontal sectional view of part of the tape strainers shown in FIG. 4 in a position, in which a tape bending-over member of one tape strainer is halfway slipped out, FIG. 6 is a horizontal sectional view like that shown in FIG. 5 in a position, in which the tape bending-over member of one tape strainer is urged back into its initial position and simultaneously the tape bending-over member of the other tape strainer is slipped out, FIG. 7 is a front view of the tape strainer with a bending-over member and a cutting member and FIG. 8 is a diagram of a hydraulic driving system for the tape strainers the bending-over members and the cutting members of the taping device shown in FIGS. 1 to 7.

Referring to the drawing, reference numeral 1 designates a stationary base frame, 2 a roller track for conveying loading boards 3 (palets) and 4 columns disposed on both sides of the roller track 2 on the base frame 1 and being adjustable in a direction of height. Each column 4 holds four taping devices 5, some of which are omitted. Each taping device 5 comprises a holder slidably and fixably arranged on a column for a tape supply reel 6, a guide roller 7 and a composite tape strainer 8. Every taping device 5 of one column 4 co-operates with a taping device of the other column. The two co-operating taping devices are located at the same height above the roller track 2.

Initially, in a manner not shown in detail, a tape is stretched between the two supply reels 6, said tape being formed by the tapes 9 emanating from the supply reels 6 and having their ends interconnected. When a loading board 3 with an object or a stack of objects 10 is displaced in the direction of the arrow 11 along the roller track 2, the tape 9 is applied in the form of a U around the stack of objects 10 in the manner shown in FIG. 1. The supply reels can rotate only against a heavy frictional force so that the tapes 9 are kept taut.

When the loading board 3 with the objects 10 has arrived at the position shown in FIG. 1. The loading board 3 is retained for a short time and the tape strainers 8 are moved towards one another in the manner illustrated in FIGS. 2 and 3. Thus the tape portion extending between the stack of objects 10 and the supply reels 6 approach one another along said stack. It should be noted that the right-hand tape strainer is moved more rapidly towards its operative final position than the left-hand tape strainer. Just before the right-hand tape strainer arrives at its end position, a stop member 13 having two side plates 14 and mounted on said tape strainer for pivoting about a transverse pin 12 is turned by a fixed cam 15 out of a downwardly inclined position into a horizontal position and moved with its side plates 14 into alignment with the head 16 of the tape strainer 8. The head of the tape strainer has two inclined clamping faces 17 and a head face 18 extending transversely of its direction of movement between said clamping faces 17. The left-hand tape strainer 8 comprises a head 19 having inclined clamping faces 20 and a head face 21 extending transversely of the direction of movement of the tape strainer between said faces. The side plates 14 of the stop member have clamping faces 22 co-operating with the clamping faces 17, clamping faces 23 co-operating with the clamping faces 20 and supporting faces 24 extending between the clamping faces 22 and 23 in the direction of movement of the tape strainers.

During the movement of the tape strainers 8 towards one another the stop member 13 is turned into a horizontal position by the cam 15 with its clamping 22 with a slight clearance space in front of the clamping faces 17 of the head 16, that is to say, so as to be free of the tape portion 9 wound around said head 16 and then drawn with its clamping faces 22 towards the clamping faces 17, so that the tape portion 9 located in between is clamped tight at two places. A moment later the left-hand tape strainer is forced with the clamping face 20 20 of its head 19 against the clamping faces 23 of the side plates 14 of the stop member 13 so that also the left-hand tape portion 9 is clamped tight at two places.

The head face 18 of the right-hand tape strainer 8 is formed by the head of a tape bending-over member 25 constructed in the form of a piston adapted to move axially in the head 16, which bending-over member can be moved with operative bending-over faces 26 at a short distance past the supporting faces 24 of the side plates 14 of the stop member 13. Midway between the bending-over faces 26 the tape bending-over member 25 is provided with a knife 28 adapted to be slipped out of the head face 18 by means of a piston 27 for cutting the tape portions stretched across the head faces 18 and 21. The head of the left-hand tape strainer 8 is provided with a tape bending-over member 30, adapted to be moved by a piston 29. This tape bending-over member has at the centre of its head face 21 a gap 31, into which penetrates the knife 28, when cutting the left-hand tape portion 9.

As soon as the tape strainers 8 are pressed, whilst the tape strippers 25, 30 are still retracted in the position shown in FIG. 4, against the stop member 13, which is in the meantime shifted by the cam 15 into the horizontal position, the piston 27 first moves the knife 28 to the left, so that the right-hand tape portion 9 is cut, where upon the tape bending-over member 25 is also moved to the left. The separate ends of the right-hand tape portion 9 obtained by cutting, are then smoothly nestled in the manner shown in FIG. 5 against the supporting faces 24 of the side plates 14 of the stop member 13. Subsequently, the tape bending-over member 25 with its projecting knife 28, moving further to the left, cuts the left-hand tape portion 9, stretched across the head face 21 of the tape bending-over member 30, the knife 28 penetrating into the gap 31. Then the two tape strippers 25 and 30 are, in common, moved to the right. During the latter movement passages 32 opening into the bending-over faces 26 of the tape bending-over member 25 give off glue from the space 33 behind the head of the member 25 to the ends of the right-hand tape portion 9 forced against the supporting faces 24 and at the same time the ends of the left-hand tape portion 9 are pressed onto those of the right-hand tape portion and glued thereto. (FIG. 6). The tape is then closed around the stack of objects 10 and at the same time severed from the tape portions 9 originating from the supply reels 6 and interconnected whit their ends so that the stack of objects surrounded by the tape can be conveyed further and a new tape is ready for the next object of stack of objects. The space 33 is each time filled with glue from a glue supply duct 34 provided with a check valve 35, when the tape bending-over member 25 is moved to the left.

The hydraulic system shown in FIG. 8 serves to control the taping device shown in FIGS. 1 to 7. The tape strainers are constructed here in the form of double-acting cylinders 8*a*, 8*b*, adapted to move with respect to stationary pistons 36*a* and 36*b*, respectively. The cylinder spaces 8*a*′, 8*a*″, 8*b*′, 8*b*″ of these cylinders communicate through conduits 37*a*′, 37*a*″, 37*b*′, 37″, respectively, with conduits 38 and 39, which communicate via a reversing slide valve 40 either with the compression side of a pump 41 of with a fluid reservoir 42. The suction pipe of the pump 41 also communicates with the reservoir 42. The conduit 37*b*′ includes a throttle member 43. The piston coupled with the tape bending-over member 25 is exposed to the pressure in the cylinder space 8*a*′ and to that of the open air. The piston 29 having a larger diameter than the piston 27 and being coupled with the tape bending-over member 30 is exposed on one side to the pressure in the cylinder space 8*b*′ and on the other side to the pressure in the cylinder space 44. The cylinder space 44 communicates through a conduit 45 including a hydraulically controlled valve 46 with the conduit 39. The cylinder space 46′ of the valve 46 communicates through two parallel conduits 47*a*, 47*b* including oppositely directed loaded check valves 48*a*, 48*b* with the conduit 38 and the cylinder space 46″ of said valve communicates through two parallel conduits 49*a*, 49*b* including oppositely directed, loaded check valves 50*a*, 50*b* with the conduit 39. Between the compression side and the suction side of the pump 41 there is arranged a circulating conduit 51 including a loaded safety valve 52 opening towards the suction side. The load on the safety valve 51 exceeds that on the check valves 48*a* and 50*a* and the load on the latter valves is higher than that of the check valves 48*b* and 50*b*.

This hydraulic driving system operates as follows:

In the position shown of the externally operable reversing slide valve 40 the conduit 38 is pressurized and the tape strainers 8*a* and 8*b* are moved towards one another. Owing to the decelerating effect of the throttle 43 the tape strainer 8*a* arrives earlier at its operative final position than the tape strainer 8*b*. When the tape strainer 8 has reached this end position and the stop member 13 has thus moved to its place between the tape strainers, the pressure in the cylinder space 8*a* slightly increases and the tape bending-over member 25 is forced to the left by the piston 27 against the spring 27*a* as soon as the knife 28 has been pushed out and has cut the right-hand tape portion 9 (FIG. 4). In the meantime the tape strainer 8*b* has also reached its operative terminal position and is forced with its head 19 against the stop member 13. As soon as the tape bending-over member 25 with its knife 28 attains the head of the tape strainer 8*b*. The left-hand tape portion is also severed. Since during the movement of the tape strainer 8*b* to the left the cylinder space 44 is blocked by the valve 46, the tape bending-over member 30 stays in the head 19 of the tape strainer 8*a* during said movement. When also this tape strainer 8*a* has reached its operative terminal position, the pressure in the conduit 38 increases to an extent such that the check valve 48*a* is opened and the valve 46 opens. As a result the pressure in the cylinder space 44 drops and the piston 29 of larger diameter drives the tape bending-over members 30 and 25 and the piston 27 to the right. During this movement the tape ends are pairwise glued together.

After the termination of the latter movement the reversing slide valve 40 is changed over, so that the conduit 39 is pressurized. As a result the cylinder spaces 8*a*″, 8*b*″ and 44 are pressurized, so that the tape strainers 8*a*, 8*b* are moved from one another and the tape bending-over member 30 is urged back into the head 19 of the tape strainer 8*b*. When the tape strainers 8*a* and 8*b* have reached their inoperative terminal right-hand and left-hand positions, the pressure in the conduit 39 increases to a sufficient extent to open the check valve 50*a* and to move the valve 46 back into its closed state.

In order to perform a new taping cycle the reversing slide 40 has to be returned to the position shown.

What I claim is:

1. A method of applying a tape around an object or a stack of objects, in which a tape extending between two supply reels and consisting of two tapes, which emanate from individual supply reels and have their ends interconnected, is passed in U-shaped fashion around the object or the stack of objects and subsequently the tape portions then extending between the object of the stack of objects and the supply reels are forced towards one another along the object or the stack of objects and connected with one another and severed in a manner such that the object or the stack of objects is surrounded by a closed tape. and whereby a tape extending between said supply reels and consisting of tapes, which emanate from individual supply reels and have their ends interconnected, is again formed, characterized in that each of the two tape portions forced towards one another is clamped tight at a given distance from the other tape portion at two places spaced apart by about twice said given distance in a direction transverse of the object or the stack of objects, after which in order of succession, one tape portion is cut at a spot midway between its two clamping places, the tape ends thus formed between said clamping places and facing one another are directed towards the other tape portion, this other tape portion is also cut at a spot midway between its two clamping places, the resulting tape ends of the other tape portion facing one another are bent over, forced against the tape ends of the first-mentioned tape portion and jointed thereto, where upon the clamped tape portions are released.

2. A device for applying a tape around an object or stack of objects comprising two tape supply reels arranged at a distance from one another in the same plane, two tape strainers associated one with each supply reel and adapted to move in said plane parallel to a line connecting the axes of said supply reels towards one another and away from one another in order to force towards one another around an object or a stack of objects the portions of a tape extending between said object or stack of objects and the supply reels, which tape is already passed in U-shaped fashion around said object or stack of objects and consists of tapes, which emanate from the two supply reels and have their ends interconnected and means arranged on the tape strainers for adhering to one another the tape portions forced towards one another by the tape strainers and means arranged on the tape strainers for cutting said tape portions, characterized in that the tape strainer ends facing each other are each bounded by two clamping faces and an intermediate head face extending transversely of the direction of movement of the tape strainers, a stop member having two parallel side plates adapted to be inserted between the two tape strainers, said side plates being bounded each by a clamping face co-operating with a clamping face of one tape strainer, a clamping face co-operating with a clamping face at the other tape strainer and a supporting face extending between said clamping faces in the direction of movement of the tape strainers and facing the other side plate, the dimension of said supporting face in the direction of movement of the tape strainers being approximately equal to half the dimension of the head faces of the tape strainers transverse of said supportng face, the head face of each tape strainer being formed by the head face of a tape bending-over member, which is displaceable with respect to its tape strainer at least over a distance equal to the dimension of the supporting faces in the direction of movement of the tape strainers towards the other tape strainer and moves, during its displacement, with its operative bending-over faces closely along the supporting faces of the side plates of the stop member, at least one of the two tape bending-over members having, midway between the clamping faces of the tape strainer concerned, a cutting member adapted to be pushed out of its head face, means being provided for jointing overlapping tape ends extending along the supporting faces of the side plates of the stop member and in that driving means are provided for moving in a given order of succession the tape strainers, the stop member, the or each cutting member, the tape bending-over members and the tape jointing means.

3. A device as claimed in claim 2 characterized in that the clamping faces of the tape strainers and the clamping faces of the stop member extending parallel to the former are inclined outwardly with respect to the head faces and the supporting faces, respectively, and inclined to the rear with respect to the effective movement of the tape strainers.

4. A device as claimed in claim 3 characterized in that the stop member is mounted on one of the tape strainers for pivoting about an axis extending transversely of the direction of movement of the tape strainers.

5. A device as claimed in claim 2 characterized in that the tape bending-over member provided with the cutting member is coupled with a piston adapted to move in a cylinder cavity of the head of the tape strainer concerned and the cylinder space on the side of the piston remote from the head face of said tape bending-over member communicates with glue discharge passages opening into the active bending faces of said bending-over member facing the supporting faces of the side plates of the stop member as well as with a glue supply duct provided with a check valve opening towards said space.

6. A device as claimed in claim 5 characterized in that at least one of the tape bending-over members and/or each side plate of the stop member is provided with a heating element.

* * * * *